US010044135B2

(12) United States Patent
Revol et al.

(10) Patent No.: US 10,044,135 B2
(45) Date of Patent: Aug. 7, 2018

(54) COMPACT HIGH VOLTAGE CONNECTOR

(71) Applicant: SINGLE BUOY MOORINGS INC., Marly (CH)

(72) Inventors: Gerard Revol, Cagnes sur Mer (FR); Georges Dixneuf, Cannes la Bocca (FR); Eric Murris, Nice (FR); Terrence Lallouette, Nice (FR); Samir Boutahar, Nice (FR)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 14/909,153

(22) PCT Filed: Aug. 1, 2014

(86) PCT No.: PCT/EP2014/066593

§ 371 (c)(1),
(2) Date: Feb. 1, 2016

(87) PCT Pub. No.: WO2015/014985

PCT Pub. Date: Feb. 5, 2015

(65) Prior Publication Data

US 2016/0164221 A1 Jun. 9, 2016

(30) Foreign Application Priority Data

Aug. 1, 2013 (EP) ..... 13178953

(51) Int. Cl.
*H01R 13/53* (2006.01)
*H01R 13/527* (2006.01)
(Continued)

(52) U.S. Cl.
CPC ..... *H01R 13/527* (2013.01); *H01R 13/5219* (2013.01); *H01R 13/53* (2013.01); *H01R 13/5202* (2013.01); *H01R 2101/00* (2013.01)

(58) Field of Classification Search
CPC .. H01R 13/53; H01R 13/527; H01R 13/6485; H05F 1/00; H05K 9/00
(Continued)

(56) References Cited

U.S. PATENT DOCUMENTS 2,379,942 A * 7/1945 Webber ..... H01R 13/621
174/102 SC
3,509,516 A * 4/1970 Phillips ..... H01R 13/53
174/18
(Continued)

FOREIGN PATENT DOCUMENTS

CN 200 956 449 10/2007
DE 30 41 337 9/1982
(Continued)

OTHER PUBLICATIONS

International Search Report dated Oct. 15, 2014, corresponding to PCT/EP2014/066593.

*Primary Examiner* — Hien Vu
(74) *Attorney, Agent, or Firm* — Young & Thompson

(57) ABSTRACT

A high voltage connector includes an electric terminal and a housing elongated in a first direction along a longitudinal axis of the connector. An end surface of the electric terminal is mounted on an proximal end surface of the elongated housing with the respective body axis directions of the housing and the connector in parallel, and is arranged with an outer electric connection area for connection to an external electric terminal. The elongated housing is arranged at a distal end to receive at least one power cable for internal electrical connection of the at least one power cable with an inner connecting area of the electric terminal. The high voltage connector includes an encapsulating casing that encloses the electric terminal and the elongated housing in the first direction, and the encapsulating casing provides a closed space between the casing and the housing.

18 Claims, 5 Drawing Sheets

(51) Int. Cl.
*H01R 13/52* (2006.01)
*H01R 101/00* (2006.01)

(58) Field of Classification Search
USPC ..... 439/186, 181, 88, 921
See application file for complete search history.

(56) References Cited

U.S. PATENT DOCUMENTS

| | | | | | |
|---|---|---|---|---|---|
| 3,509,518 | A * | 4/1970 | Phillips | H01R 4/4863 | 174/70 R |
| 3,851,296 | A * | 11/1974 | Muchmore | H02G 15/10 | 439/275 |
| 3,888,559 | A * | 6/1975 | Geib | H01R 13/635 | 439/157 |
| 4,865,559 | A * | 9/1989 | Clabburn | H01R 13/53 | 439/281 |
| 7,166,024 | B2 | 1/2007 | Mashiko | | |
| 2003/0216119 | A1 | 5/2003 | Mashiko | | |

FOREIGN PATENT DOCUMENTS

| | | |
|---|---|---|
| EP | 1 363 484 | 11/2003 |
| GB | 2 198 596 | 6/1988 |
| WO | 2007/068278 | 6/2007 |
| WO | 2012/059518 | 5/2012 |

* cited by examiner

COMPACT HIGH VOLTAGE CONNECTOR

FIELD OF THE INVENTION

The present invention relates to a high voltage connector. Also the invention relates to a swivel stack comprising such a high voltage connector.

BACKGROUND

Currently, high voltage connectors exist for use in electrical systems in a so called explosive atmosphere. Such environment can relate to various industrial facilities, for example, automotive refueling stations or petrol stations, oil refineries, rigs and offshore processing plants, chemical processing plants, underground coalmines and gas pipelines and distribution centers.

To avoid explosions caused by electrical discharge in air, existing certified high voltage connectors to be compliant with IEC/EN standard had to be limited to a maximum voltage of 11 kV (IEC: International Electrotechnical Commission).

The limitation of the high voltage level, may adversely limit electrical (power) system in industrial facilities. If higher voltage levels are needed dedicated solutions are required as alternative for the high voltage connector. Typically, such a standard solution like a dedicated junction box would require a larger foot print of the installation. In offshore applications such as a swivel stack on a floating (production) storage and offloading unit (FPSO/FSO), the use of standard junction boxes with cable glands instead of a high voltage connector would be oversized and not suitable with the requirements for relatively compact design.

It is an object of the invention to overcome or mitigate the disadvantages from the prior art.

SUMMARY OF THE INVENTION

The object is achieved by a high voltage connector as defined in claim 1, which comprises an electric terminal and a housing elongated in a first direction along a longitudinal axis of the connector; an end surface of the electric terminal being mounted on an proximal end surface of the elongated housing with the respective body axis directions of said housing and said connector in parallel, and arranged with an outer electric connection area for connection to an external electric terminal; the elongated housing at a distal end being arranged to receive at least one power cable for internal electrical connection of the at least one power cable with an inner connecting area of the electric terminal, wherein the high voltage connector comprises an encapsulating casing that encloses the electric terminal and the elongated housing in the first direction, and the encapsulating casing provides a closed space between said casing and the housing.

The high voltage connector according to the invention provides that advantageously a high voltage connector of standard dimensions can be used for higher voltage applications above the standardized high voltage limit.

The encapsulating casing surrounds the housing as a shell with a space between its wall and the housing. The encapsulating casing provides by the closed space surrounding the connector an additional barrier between the explosive atmosphere and the connector.

The casing is provided with at least one flame path of any type e.g. spigot, flat, threaded, etc., that acts to prevent transmission of the explosion from the inside to the outside of the casing.

Moreover, the encapsulating casing provides a protection of the high voltage connector from sunlight and thus suppresses solar and UV radiation ageing effects on the components of the high voltage connector.

According to an aspect, the closed space is substantially flame proof. According to an aspect the invention relates to a high voltage connector as described above, wherein the closed space is substantially liquid proof and dust proof, which provides an isolation of the interior of the casing from the explosive atmosphere.

According to an aspect the invention relates to a high voltage connector as described above, wherein the encapsulating casing comprises a connector socket enclosing a radial wall of the electric terminal in the first direction with an opening of the socket at the location of the outer electric connection area.

In this manner the connector socket provides a radial insulating wall that prevents electrical contact and sparking of the connector in a radial direction.

According to an aspect the invention relates to a high voltage connector as described above, wherein the encapsulating casing comprises a cable gland adjacent to the housing's distal end for allowing passage of the power cable. In this manner the casing is fixed to the power cable. Further, this permits to control the fluid barrier and to have the casing liquid tight and dust tight.

According to a further aspect the invention relates to a high voltage connector as described above, wherein the encapsulating casing comprises one or more brackets for fixing the power cable. Such electrical fixings avoid or spare the use of the power cable gland to withstand the force produced during a short circuit current event. In this manner, the mechanical requirements for the design of the encapsulating casing can be relaxed.

According to an aspect the invention relates to a high voltage connector as described above, wherein the encapsulating casing comprises one or more sealable openings for access to the closed space.

Such sealable openings that are placed radially along the casing, can be used for inspection of the closed space or for wiring the closed space in relation to additional electrical functions such as earthing or screening.

According to an aspect the invention relates to a high voltage connector as described above, wherein the sealable opening comprises an earthing cable gland for allowing passage of one or more electrically independent earthing cables.

According to an aspect the invention relates to a high voltage connector as described above, wherein the sealable opening is arranged for access to the closed space by a borescope-type probe. This feature allows relatively easy inspection without long downtime, electrical disconnection and/or mechanical dismantling.

According to an aspect the invention relates to a high voltage connector as described above, wherein the receptacle volume comprises a first shell at one end coupled to the proximal end and enveloping a portion of the housing along the first direction with a end flange, and a second shell sealably coupled to the end flange of the first shell and enclosing the distal end of the housing. The receptacle volume is constructed from two shell parts: the first shell is coupled as a collar to the proximal end of the housing and extends along a part of the housing. The second shell is a cover that couples to the flange of the first shell and creates the closed space surrounding the housing.

According to an aspect the invention relates to a high voltage connector as described above, wherein a proximal end of the connector socket is sealably connected to the first shell at a connecting location adjacent the proximal end of the elongated housing. By the sealable connection between the socket and the first shell of the encapsulating casing the surface of the electric terminal at the proximal end of the housing is covered and shielded from the environment.

According to an aspect the invention relates to a high voltage connector as described above, wherein the first shell comprises a raised peripheral edge directed towards the electric connection area of the electric terminal and the proximal end of the connector socket is positioned at the connecting location within the raised peripheral edge. The first shell forms a collar that extends towards the electric connection area and that surrounds the interface between the socket and the first shell to further cover and shield the electric terminal at the proximal end of the housing from the environment. Also, the collar of the first shell acts as a fit for a wall in which the high voltage connector is to be mounted.

According to an aspect the invention relates to a high voltage connector as described above, wherein a resin or cemented joint is applied between the proximal end of the connector socket and a wall of the second collar facing the connector socket or is fully integrated into the connector socket.

According to an aspect the invention relates to a high voltage connector as described above, wherein the connector socket is an insulating body and the receptacle volume is either insulating or conductive.

According to an aspect the invention relates to a high voltage connector as described above, wherein the electric terminal and the elongated housing are substantially cylindrical bodies, and the encapsulating casing is substantially cylindrical.

Further the present invention relates to a swivel stack comprising an electric swivel with a high voltage connector as described above.

The present invention relates to all explosive atmospheres and is not limited to those relative to oil and gas industries even if the present invention also relates to a floating storage and offloading, FSO, vessel or a floating production storage and offloading, FPSO, vessel comprising a swivel stack as described above.

Advantageous embodiments are further defined by the dependent claims.

BRIEF DESCRIPTION OF DRAWINGS

The invention will be explained in more detail below with reference to drawings in which illustrative embodiments of the invention are shown. It should be understood that the following descriptions are not intended to limit the embodiments to one preferred embodiment.

DESCRIPTION OF EMBODIMENTS

Figure 1:
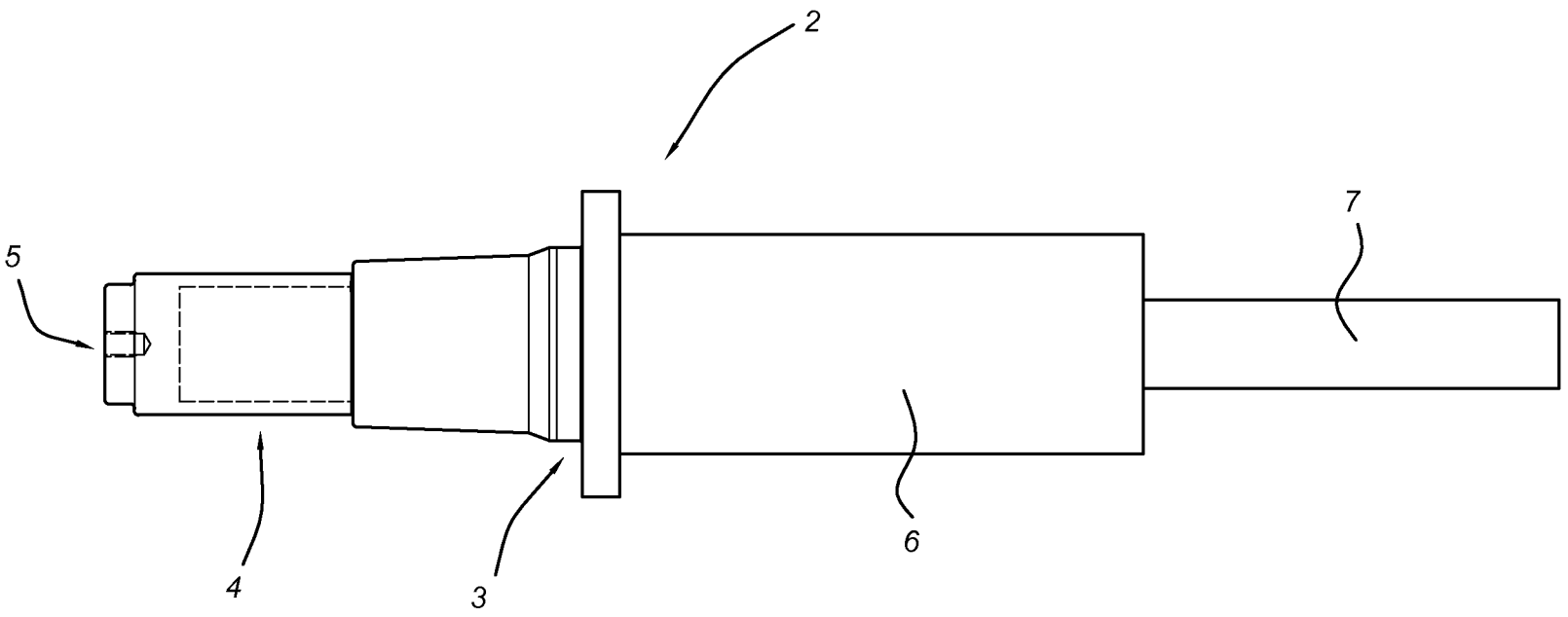
Fig. 1 Prior art
FIG. 1 shows a schematic view of a high voltage connector according to the prior art.

FIG. 1 shows a schematic view of a high voltage connector according to the prior art.

The prior art high voltage connector 2 may have a substantially cylindrical shape and comprises an electric terminal 4 and a housing 6 elongated in a direction X along its body-axis. One end surface of the electric terminal 4 is mounted on a proximal end surface 3 of the elongated housing 6 in such a way that the body axes of the electric terminal 4 and the housing 6 are at least parallel and optionally coincide.

The other end surface of the electric terminal 4 is arranged with an outer electric connection area 5 for connecting to an external electric terminal (not shown).

At its distal end the elongated housing 6 is arranged to receive a power cable 7 for internal electrical connection of the power cable with an inner connecting area of the electric terminal 5.

The prior art high voltage connector 2 corresponds to a standard high voltage connector which can be used in explosive atmosphere conditions compliant with IECEx or ATEX regulations or any other worldwide hazardous area certifications.

Figure 2:
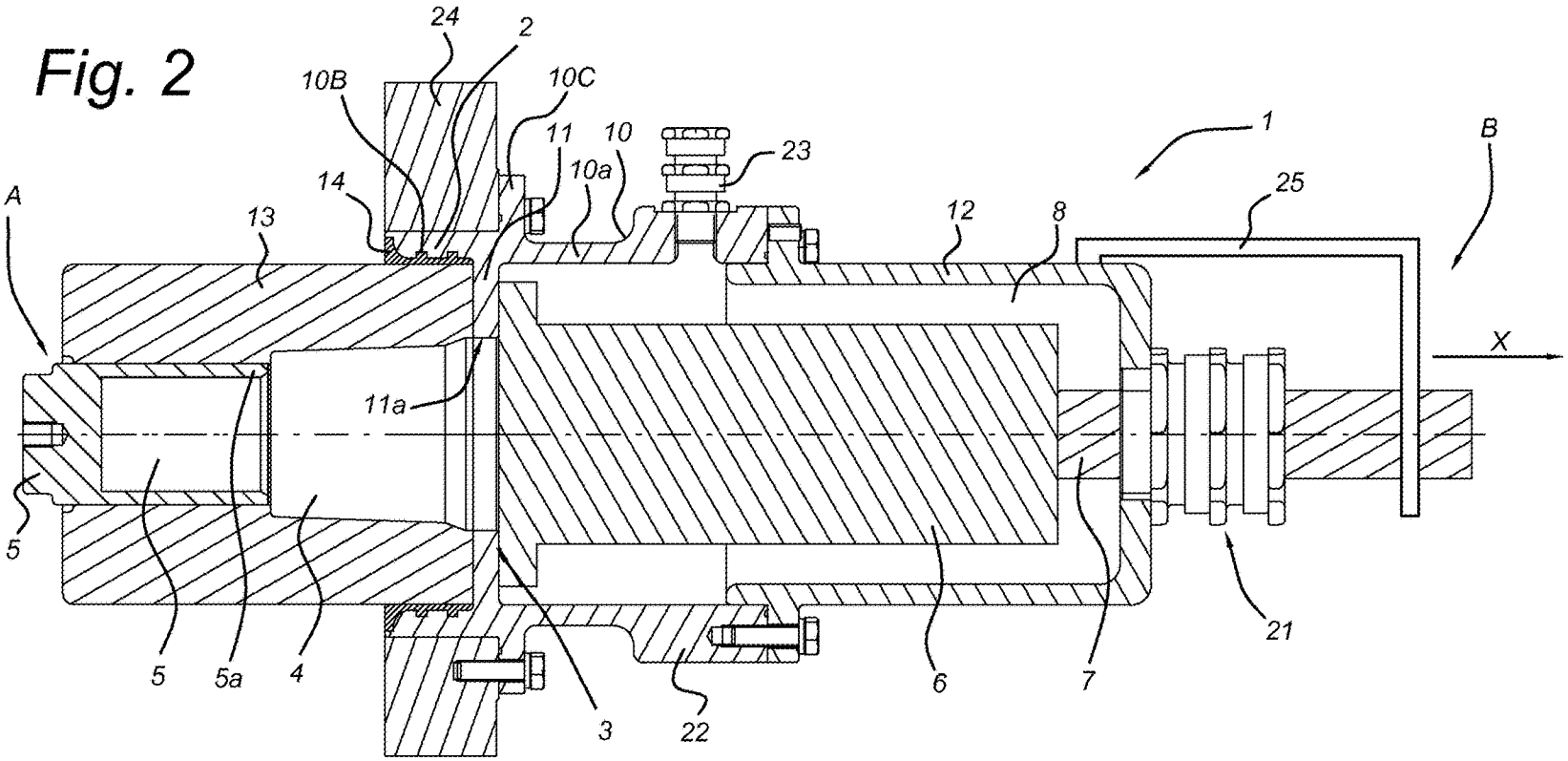
FIG. 2 shows a cross-section of a high voltage connector according to an embodiment of the invention.

FIG. 2 shows a cross-section of a high voltage connector according to an embodiment of the invention.

The high voltage connector 1 according to the invention has an internal construction of a standard high voltage connector 2 as schematically shown in FIG. 1.

The high voltage connector 1 has a substantially cylindrical body which at one end A has a substantially cylindrical electric terminal 4 with an electric connection area 5. The electric connection area 5 is arranged to couple to an electric connection area of a second electric terminal (not shown).

At the other end B of the high voltage connector, along the direction X of the cylinder axis, the high voltage connector 1 is connected to a power cable 7.

The high voltage connector 1 comprises an encapsulating casing 13, 10, 12 which surrounds the electric terminal 4 and the connector housing 6 and creates a closed space 8 between the encapsulating casing and the housing 6. The encapsulating casing provides a separation of the high voltage connector from the environment which is beneficial in case of an explosive atmosphere to avoid explosions due to sparking of the high voltage connector.

In an embodiment, the closed space is flame proof, liquid proof or liquid tight and dust proof or dust tight.

Further, the encapsulating casing comprises a connector socket 13 that surrounds the radial wall 4*a* of the electric terminal 4 as a collar and prevents contact of the radial wall 4*a* with the environment.

In the embodiment of FIG. 2, the encapsulating casing comprises three parts 13, 10, 12 that are coupled together to form the encapsulating casing. The encapsulating casing comprises the connector socket 13 that surrounds the radial wall of the electric terminal portion of the high voltage connector. The connector socket 13 is connected to a first shell portion 10 that has a wall 11 perpendicular to the cylinder axis, which wall adjoins the proximal end surface 3 of the elongated housing 6. The electric terminal passes through an aperture 11*a* of the wall 11. At the outer circumference the wall 11 has a cylindrical portion 10*a* that extends and surrounds along a portion of the elongated housing as an enveloping collar.

On the cylindrical portion 10*a* the first shell 10 comprises an annular section 22 with one or more sealable openings 23*a* for access into the interior of the encapsulating casing, i.e., the closed space 8.

Such openings 23*a* can be arranged as inspection points for optical inspection of the closed space 8, for example by a borescope.

Another sealable opening 23 can be used as an earthing cable gland for allowing passage of an earthing cable into the high voltage connector. Grounding of the power cable's screen and armor can be routed via the sealable opening and the earthing cable to a main earthing of the electrical apparatus (not shown) equipped with the high voltage connector according to the invention.

Also, such sealable openings could be used as access port to a screening device in the closed space.

At an open end of the cylindrical portion 10*a*, the first shell is sealably connected to an open end of a second shell 12 that surrounds and covers the portion of the elongated housing 6 not surrounded by the cylindrical portion of the first shell 10. The open ends of the cylindrical portion 10*a* and the second shell 12 may each comprise an end flange.

On the encapsulating casing at end B, a cable gland 21 is provided in the second shell with a passage for the power cable 7 into the closed space.

Additionally, the first shell 10 may comprise a secondary cylindrical portion 10*b* that extends from the wall 11 towards the electric connecting area 5 as a second enveloping collar over a portion of the connector socket 13.

In a gap 14 between the secondary cylindrical portion 10*b* and the connector socket 13 a resin or cemented joint may be applied for sealing. Alternatively, the gap and the connector socket can be overmolded in one processing step to form directly one integral piece made of resin or cemented joint. In this particular embodiment the cemented joint is fully integrated in the connector socket 13, so that the gap 14 and the socket 13 are integral and made as one single cemented joint feature.

The first shell 10 also may comprise an outward flange 10*c* for a mechanical coupling with an external wall 24.

In a further embodiment, the encapsulating casing comprises one or more brackets 25 for fixing the power cable 7.

Figure 3:
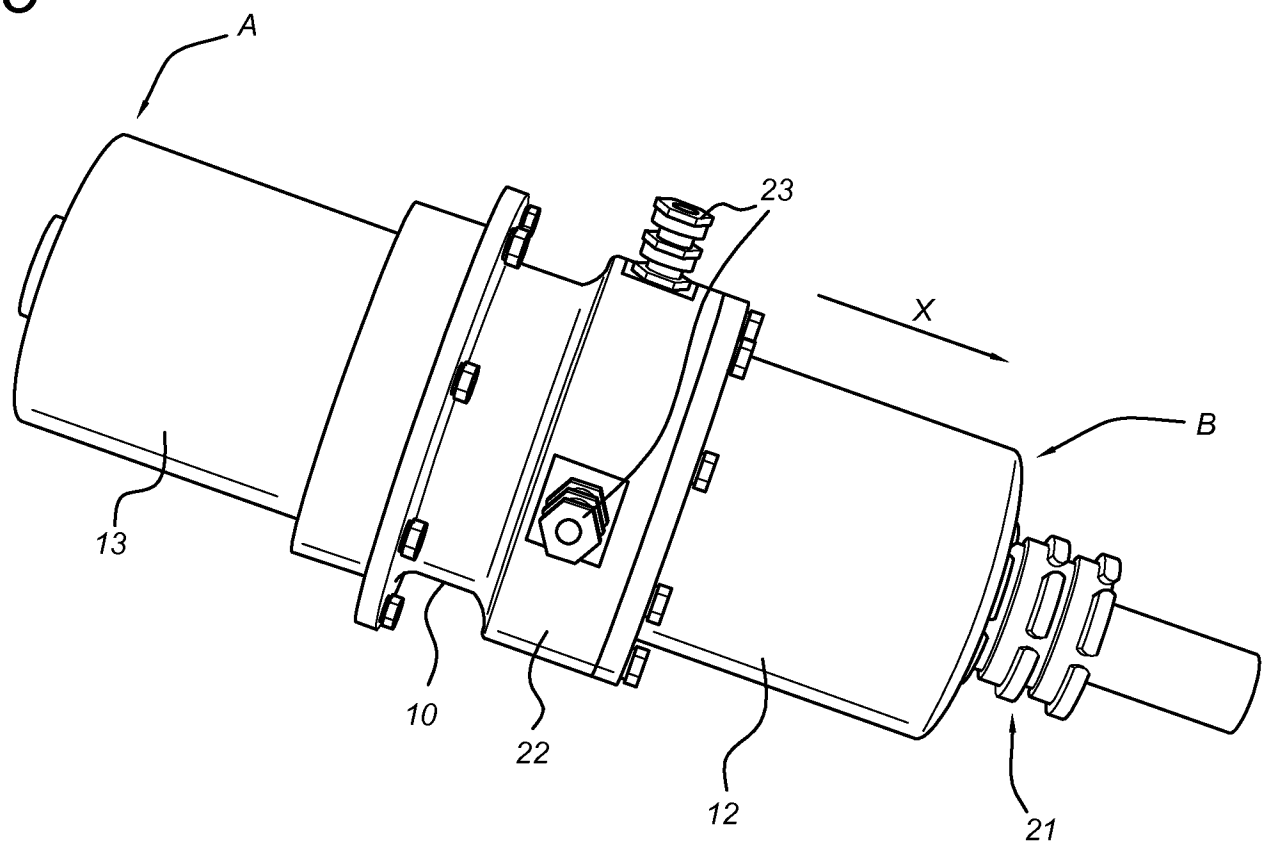
FIG. 3 shows a perspective view of a high voltage connector according to an embodiment of the invention.

FIG. 3 shows a perspective view of an encapsulating casing for a high voltage connector according to an embodiment of the invention.

The high voltage connector according to the invention achieves a beneficial improvement of its performance in explosive atmosphere by separating the area susceptible to sparking from the environment. As a result, the high voltage connector can be used at higher voltage than allowable by prior art connectors as shown in FIG. 1. Also higher currents may be allowable.

The high voltage connector according to the invention can be used for any electric appliance in hazardous areas either onshore or offshore, including motors, VFD/VSD drivers, transformers.

The high voltage connector of the invention can be applied in a swivel stack as used on offshore installations e.g. FSO and FPSO units, etc., where the high voltage connector is used in the HV swivel stack part for high voltage power cables extending through the stack and into all other explosive atmospheres and not only to those relative to oil and gas industries.

Figure 4:
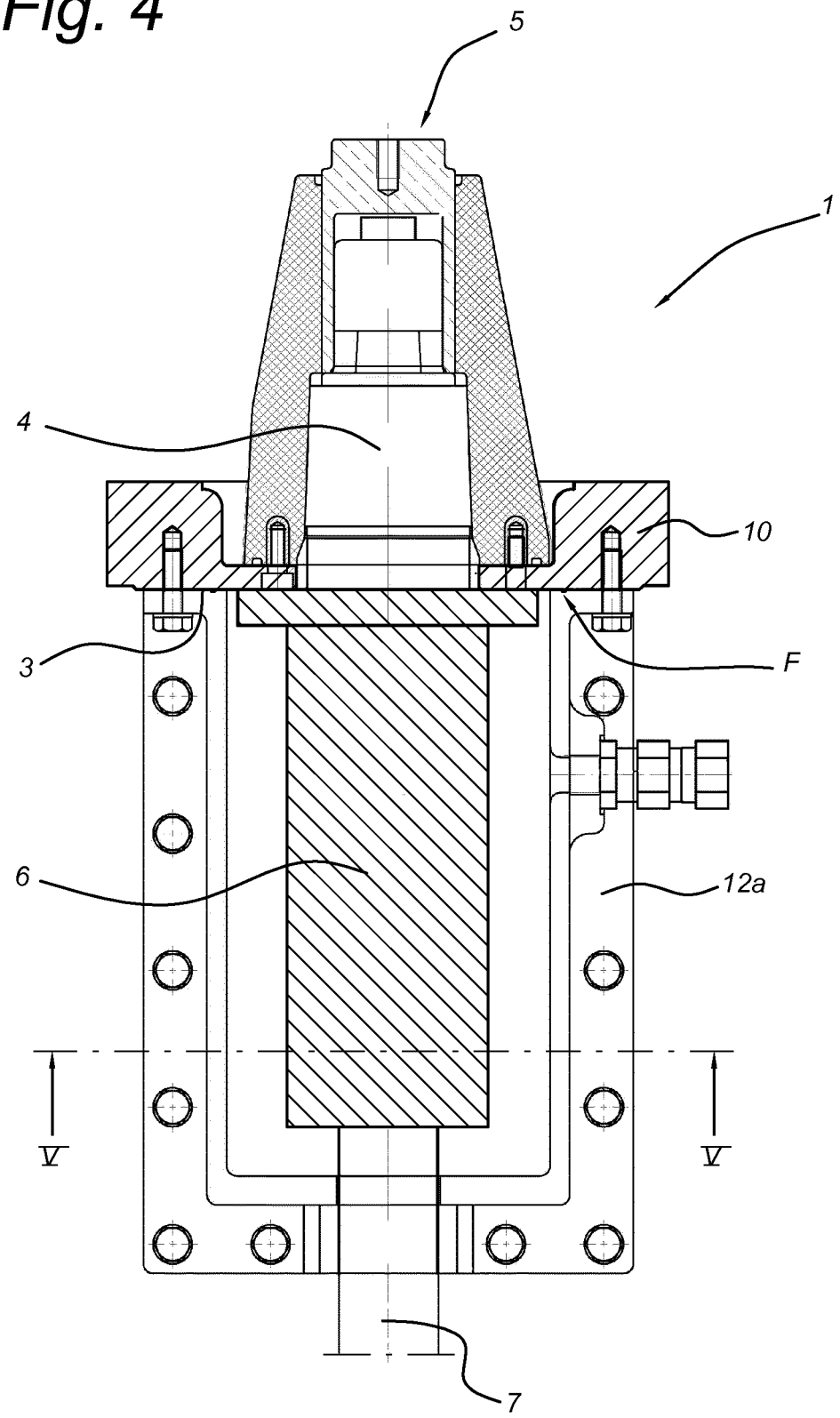
FIG. 4 shows a cross-section of a high voltage connector according to an embodiment of the invention.

FIG. 4 shows a cross-section of a high voltage connector according to an embodiment of the invention. The high voltage connector is plugged into an electrical system and is located on the enclosure of the electric system at the interface between the connector socket 4 and the proximal end 3 of the housing which is in this particular case between the electrical system and the connector. The encapsulating casing 12*a* is a sleeve-like shell that encloses the elongated housing 6 and defines by its wall the closed space 8 around the elongated housing.

The shell and the enclosure of the electrical system may be joint by bolts. A flame path is also provided at the location indicated by reference F in FIG. 4, between the electrical system and the connector. At the location of the distal end of the housing the shell comprises a sealable second opening 10*f* for passage of the conductor cable 7.

Figure 5:
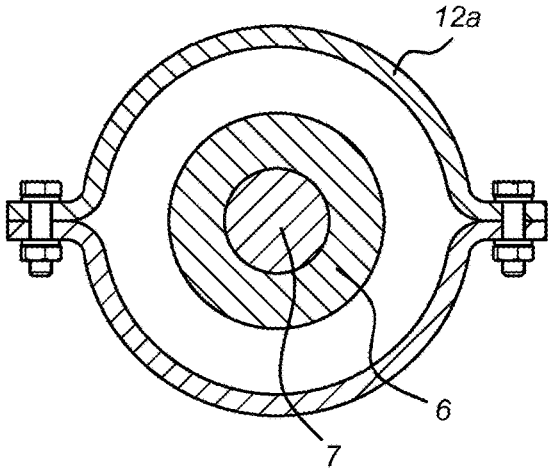
FIG. 5 shows a further cross-section of the high voltage connector of FIG. 4.

FIG. 5 shows a further cross-section of the high voltage connector of FIG. 4, along line V-V. The encapsulating casing comprises two shell plates substantially parallel to each other that are joint at their interfacial edges.

It will be appreciated by the person skilled in the art that other alternative and equivalent embodiments of the invention can be conceived and reduced to practice without departing from the true spirit of the invention, the scope of the invention being limited only by the appended claims.

The invention claimed is:

1. A high voltage connector comprising an electric terminal and a housing elongated in a first direction along a longitudinal axis of the high voltage connector;

an end surface of the electric terminal being mounted on an proximal end surface of the elongated housing with the respective body axis directions of the housing and connector in parallel, and arranged with an outer electric connection area for connection to an external electric terminal;

the elongated housing at a distal end being arranged to receive at least one power cable for internal electrical connection of the at least one power cable with an inner connecting area of the electric terminal, wherein the high voltage connector comprises an encapsulating casing that encloses the electric terminal and the elongated housing in the first direction, and the encapsulating casing provides a closed space between said casing and the housing, wherein the encapsulating casing comprises a radial insulating connector socket enclosing and contacting and surrounding a radial wall of the electric terminal along the first direction with an opening of the socket at the location of the outer electric connection area; the connector socket being sealably connected to a connecting location at the proximal end of the elongated housing;

wherein the encapsulating casing comprises one or more sealable openings along the first direction for access to the closed space.

2. The high voltage connector according to claim 1, wherein the electric terminal and the elongated housing are substantially cylindrical.

3. The high voltage connector according to according to claim 2, wherein the connector socket is an insulating body and the encapsulating casing comprises either insulating or conductive material.

4. The high voltage connector according to claim 2, wherein the closed space is substantially flame proof.

5. The high voltage connector according to claim 1, wherein the closed space is substantially flame proof.

6. The high voltage connector according to claim 1, wherein the closed space is substantially liquid proof and dust proof.

7. The high voltage connector according to claim 1, wherein the encapsulating casing comprises a cable gland adjacent to the housing's distal end for allowing passage of the at least one power cable to the electric terminal.

8. The high voltage connector according to claim 1, wherein the encapsulating casing comprises one or more brackets for fixing the at least one power cable.

9. The high voltage connector according to claim 1, wherein the sealable opening comprises at least one earthing cable gland for allowing passage of at least one earthing cable.

10. The high voltage connector according to claim 1, wherein the sealable opening is arranged for access to the closed space by a borescope-type probe.

11. The high voltage connector according to claim 10, wherein the encapsulating casing comprises a first shell and a second shell sealably coupled to the open end of the first shell.

12. The high voltage connector according to claim 1, wherein the encapsulating casing comprises a first shell coupled to the proximal end of the housing; the first shell comprising a first collar enveloping a portion of the housing along the first direction, and a second shell sealably coupled to the open end of the first shell and enclosing the distal end of the housing.

13. The high voltage connector according to claim 12, wherein a proximal end of the connector socket is sealably connected to the first shell at a connecting location at the proximal end of the elongated housing.

14. The high voltage connector according to claim 13, wherein the first shell comprises a second collar directed from the proximal end of the housing towards the electric connection area of the electric terminal, and the proximal end of the connector socket is positioned at the connecting location within the second collar.

15. The high voltage connector according to claim 14, wherein a resin or cemented joint is either applied between the proximal end of the connector socket and a wall of the second collar facing the connector socket or is fully integrated into the connector socket.

16. The high voltage connector according to claim 1, wherein the encapsulating casing is substantially cylindrical.

17. A swivel stack comprising an electric swivel, the electric swivel comprising the high voltage connector according to claim 1.

18. A floating offshore installation comprising the swivel stack according to claim 17.

* * * * *